US011137189B1

(12) United States Patent
Reuter

(10) Patent No.: US 11,137,189 B1
(45) Date of Patent: Oct. 5, 2021

(54) ICE DISPENSER ASSEMBLY FOR A REFRIGERATOR APPLIANCE

(71) Applicant: Haier US Appliance Solutions, Inc., Wilmington, DE (US)

(72) Inventor: Daryl Lee Reuter, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/929,688

(22) Filed: Jul. 15, 2020

(51) Int. Cl.
*F25C 5/20* (2018.01)

(52) U.S. Cl.
CPC ..... *F25C 5/22* (2018.01); *F25C 2500/08* (2013.01)

(58) Field of Classification Search
CPC ..... F25C 5/22; F25C 5/20; F25C 5/24; F25C 2500/08
See application file for complete search history.

(56) References Cited

U.S. PATENT DOCUMENTS 8,069,887 B2 * 12/2011 Dirnberger ..... F25C 5/24 141/362
9,291,382 B2 3/2016 Bortletto
2010/0224279 A1 * 9/2010 Chou ..... F25C 5/20 141/1
2013/0091772 A1 4/2013 Berger
2013/0098949 A1 4/2013 Bauer
2013/0146612 A1 * 6/2013 Sanchez ..... F25D 25/00 222/28

FOREIGN PATENT DOCUMENTS

CN 201819501 U 5/2011

* cited by examiner

*Primary Examiner* — Cassey D Bauer
(74) *Attorney, Agent, or Firm* — Dority & Manning, P.A.

(57) ABSTRACT

An ice dispenser assembly for an ice maker is provided. The ice dispenser assembly includes a dispenser housing defining at least one side wall having a dispenser and an opening in fluid communication with the ice maker. The ice dispenser assembly also includes an ice door covering the opening. The ice door is rotatable between an open position permitting ice from the ice maker to be received through the dispenser and a closed position restricting cooled air from escaping from the ice maker. The ice dispenser assembly also includes rotatable arm coupled to the ice door for rotating the ice door between the open position and the closed position. The rotatable arm extends across the opening between a first end and a second end. The first end includes a cam. The ice dispenser assembly further includes a first torsion spring engaging the cam in the open position and the closed position, wherein a torque of the first torsion spring against the cam is greater in the closed position than the open position.

16 Claims, 12 Drawing Sheets

ICE DISPENSER ASSEMBLY FOR A REFRIGERATOR APPLIANCE

FIELD OF THE INVENTION

The present subject matter relates generally to assemblies for storing and dispensing ice, and more particularly to ice dispenser assemblies for use in refrigerator appliances.

BACKGROUND OF THE INVENTION

Certain refrigerator appliances include an ice maker. In order to produce ice, liquid water is directed to the ice maker and frozen. A variety of ice types can be produced depending upon the particular ice maker used. For example, certain ice makers include a mold body for receiving liquid water (e.g., to be frozen and formed as ice nuggets). An agitator or auger within the mold body can rotate and scrape ice off an internal surface of the mold body to form ice nuggets or cubes. Once ice is scraped off the mold body, it may be stored within an ice bin or bucket within refrigerator appliance. In order to maintain ice in a frozen state, the ice bin is positioned within a chilled chamber of the refrigerator appliance or a separate compartment behind one of the refrigerator doors. In some appliances, a dispenser is provided in communication with the ice bin to automatically dispense a selected or desired amount of ice to a user (e.g., through a door of the user appliance). Typically, a rotating agitator or sweep is a provided within the ice bin to help move ice from the ice bin to the dispenser.

For certain refrigerators, an ice door exists between the ice bin and the dispenser discharger outlet. The ice door must be capable of preventing air leaks on irregular surfaces, otherwise, air leaks cause accumulation of condensation and reduces energy efficiency. For existing dispensers, such ice doors can fail to seal properly due to certain spring limitations. For example, existing spring designs have less deflection in the closed position than open position, which is not ideal. Increase in spring forces are constrained by the torque limits of the motor that drives the door open and closed. Furthermore, increase in the existing spring force causes unwanted stress and creep in the door arm that adversely affects the door seal. Moreover, the additional forces challenge the strength limitations of the motor coupling design. In addition, the spring torque provides the only means of closing and clamping the door shut. Further, the motor does not provide any torque in the closing direction but must overcome the spring torque while opening the door.

As a result, there is a need for an improved refrigerator appliance or ice dispenser assembly that addresses the aforementioned issues.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice dispenser assembly for an ice maker is provided. The ice dispenser assembly includes a dispenser housing defining at least one side wall having a dispenser and an opening in fluid communication with the ice maker. The ice dispenser assembly also includes an ice door covering the opening. The ice door is rotatable between an open position permitting ice from the ice maker to be received through the dispenser and a closed position restricting cooled air from escaping from the ice maker. The ice dispenser assembly also includes rotatable arm coupled to the ice door for rotating the ice door between the open position and the closed position. The rotatable arm extends across the opening between a first end and a second end. The first end includes a cam. The ice dispenser assembly further includes a first torsion spring engaging the cam in the open position and the closed position, wherein a torque of the first torsion spring against the cam is greater in the closed position than the open position.

In another exemplary aspect of the present disclosure, a refrigerator appliance is provided. The refrigerator appliance may include a cabinet and a door. The cabinet may define a chilled chamber. The door may permit access to the chilled chamber. Further, the refrigerator appliance includes an ice maker received within the chilled chamber. Moreover, the refrigerator appliance includes an ice dispenser assembly for dispensing ice from the ice maker. The ice dispenser assembly includes a dispenser housing defining at least one side wall having a dispenser and an opening in fluid communication with the ice maker. The ice dispenser assembly also includes an ice door covering the opening. The ice door is rotatable between an open position permitting ice from the ice maker to be received through the dispenser and a closed position restricting cooled air from escaping from the ice maker. The ice dispenser assembly also includes rotatable arm coupled to the ice door for rotating the ice door between the open position and the closed position. The rotatable arm extends across the opening between a first end and a second end. The first end includes a cam. The ice dispenser assembly further includes a first torsion spring engaging the cam in the open position and the closed position, wherein a torque of the first torsion spring against the cam is greater in the closed position than the open position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
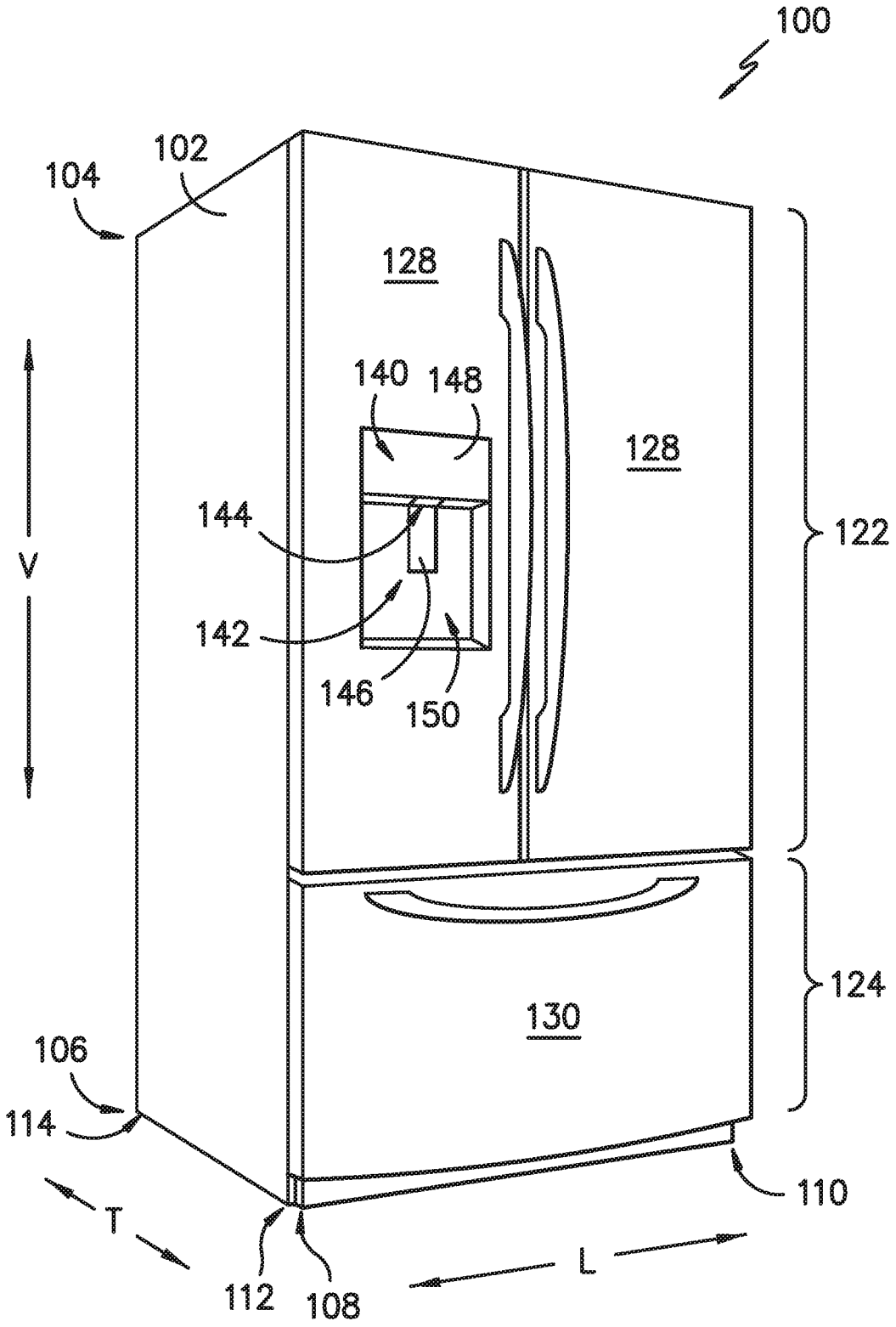
FIG. 1 provides a perspective view of a refrigerator appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
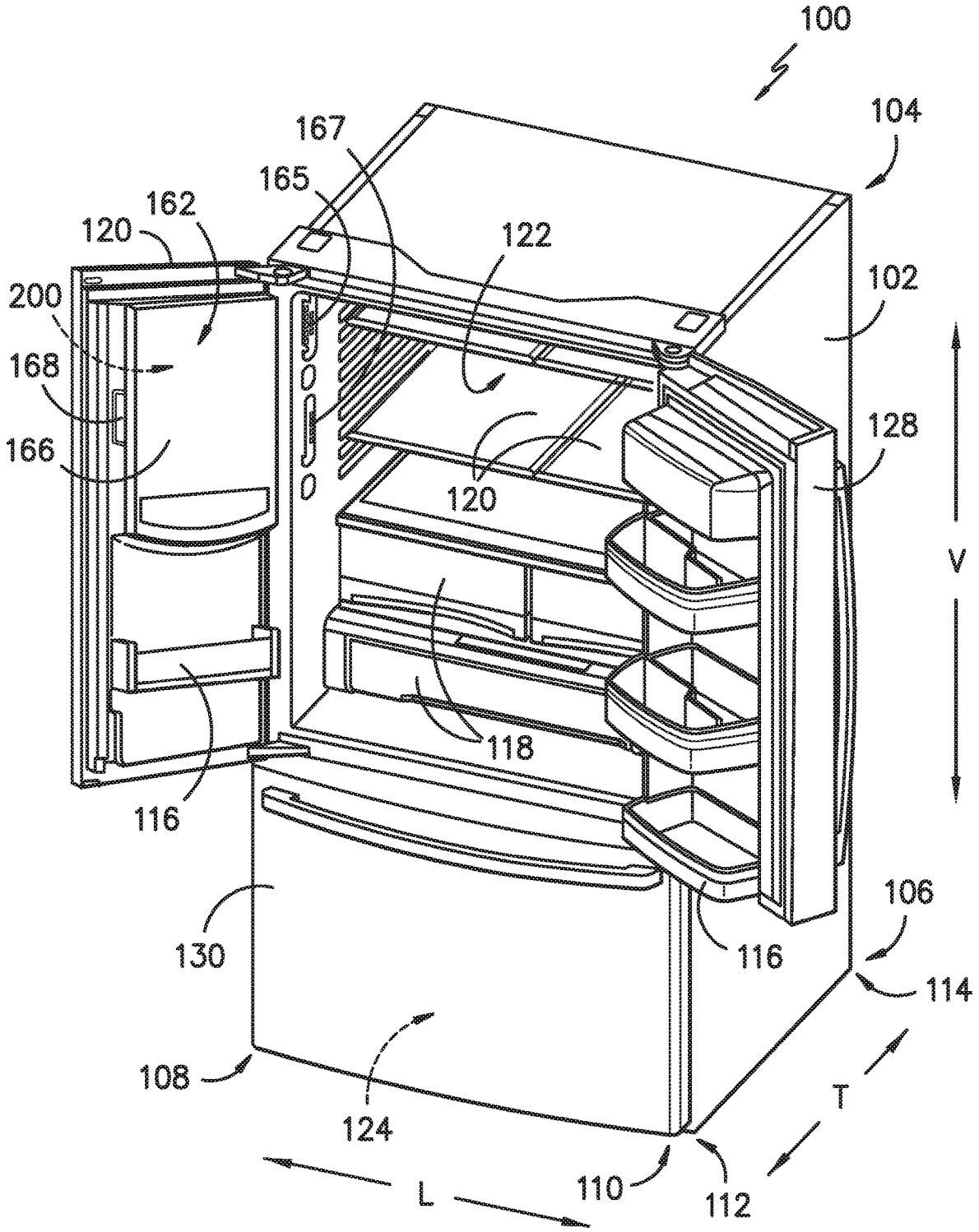
FIG. 2 provides a perspective view of a door of the example refrigerator appliance of FIG. 1.
Figure 3:
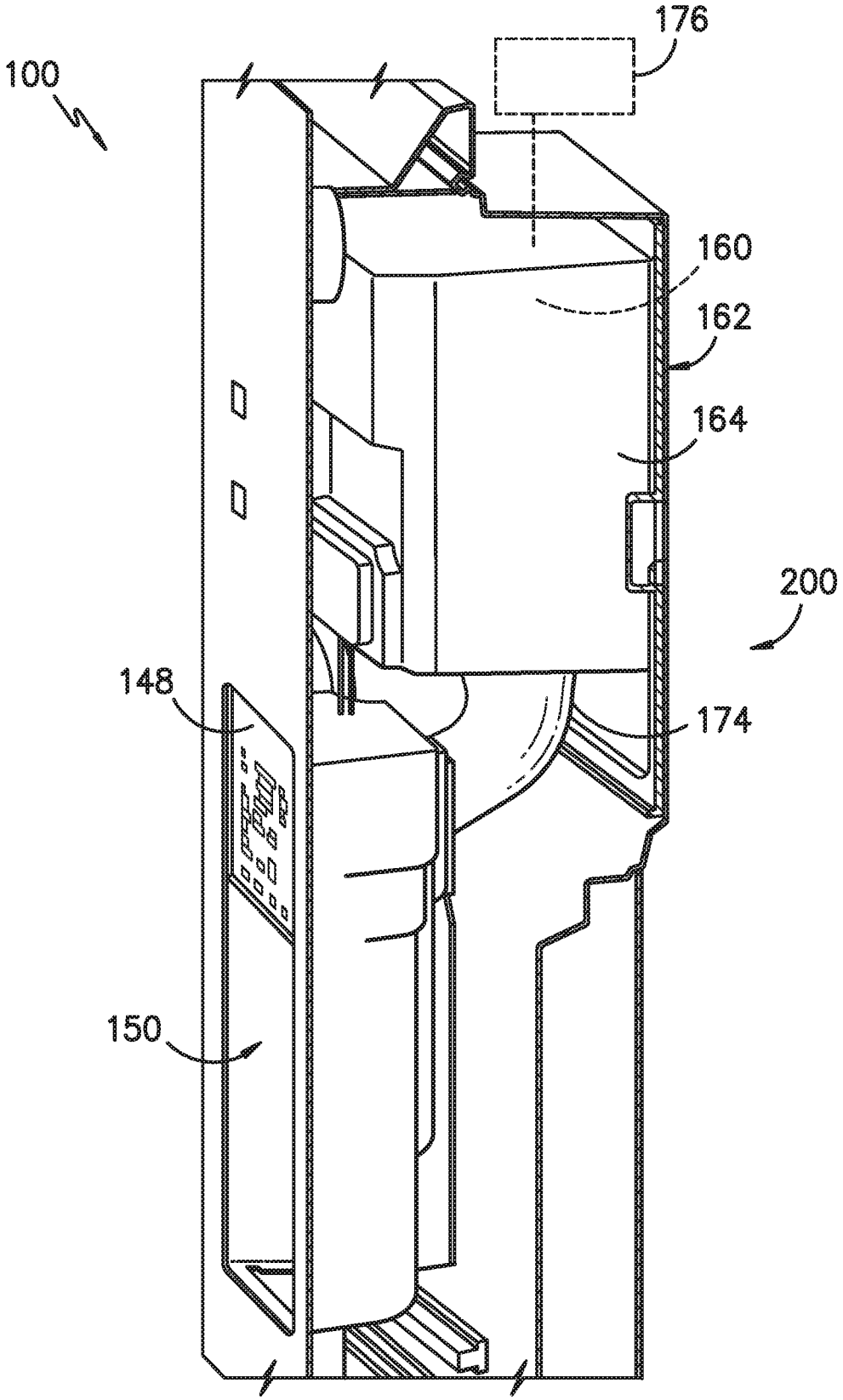
FIG. 3 provides a partial, side view of the door of the exemplary refrigerator appliance of FIG. 2.
Figure 4:
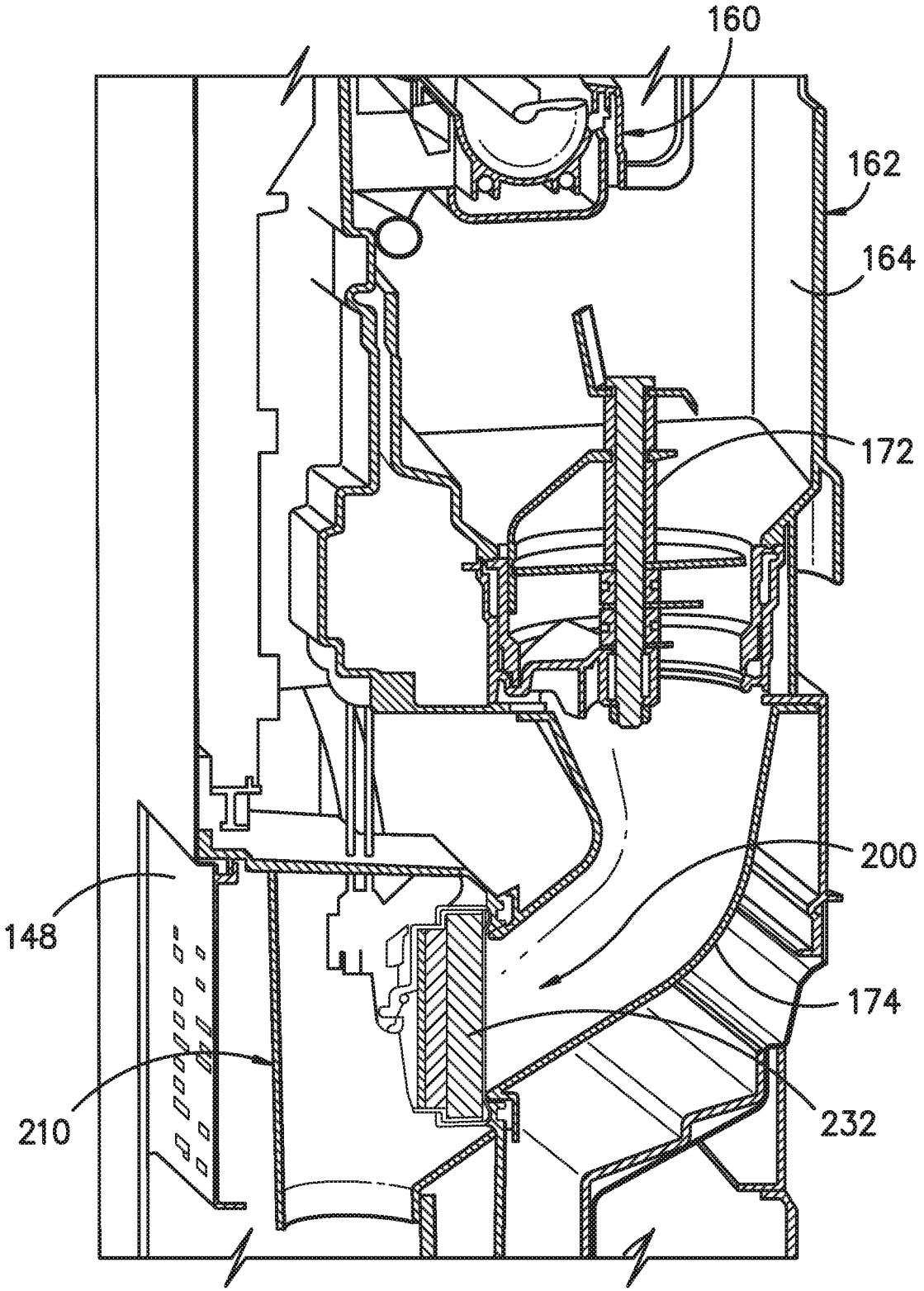
FIG. 4 provides a partial, cross-sectional view of the door of the exemplary refrigerator appliance of FIG. 2.

Turning now to the figures, FIGS. 1 and 2 provide perspective views of a refrigerator appliance (e.g., refrigerator appliance 100) according to an exemplary embodiment of the present disclosure. FIGS. 3 and 4 provide partial, side views of a refrigerator door 128 with a sub-compartment 162 having an ice making assembly 160 configured therein according to the present disclosure.

As shown, the refrigerator appliance 100 includes a cabinet or housing 102 that extends between a top 104 and a bottom 106 along a vertical direction V, between a first side 108 and a second side 110 along a lateral direction, and between a front 112 and a back 114 along a transverse direction T. Housing 102 defines one or more chilled chambers for receipt of food items for storage. In some embodiments, housing 102 defines fresh food chamber 122 positioned at or adjacent top 104 of housing 102 and a freezer chamber 124 arranged at or adjacent bottom 106 of housing 102. As such, refrigerator appliance 100 may generally be referred to as a bottom mount refrigerator.

It is recognized, however, that the benefits of the present disclosure apply to other types and styles of refrigerator appliances such as, for example, a top mount refrigerator appliance, a side-by-side style refrigerator appliance or a standalone ice-maker appliance. Consequently, the description set forth herein is for illustrative purposes only and is not intended to be limiting in any aspect to any particular refrigerator chamber configuration.

The refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

In some embodiments, various storage components are mounted within fresh food chamber 122 to facilitate storage of food items therein, as will be understood art. In particular, the storage components may include storage bins 116, drawers 118, and shelves 120 that are mounted within fresh food chamber 122. Storage bins 116, drawers 118, and shelves 120 are configured for receipt of food items (e.g., beverages or solid food items) and may assist with organizing such food items. As an example, drawers 184 can receive fresh food items (e.g., vegetables, fruits, or cheeses) and increase the useful life of such fresh food items.

In some embodiments, the refrigerator appliance 100 also includes a dispensing assembly 140 for dispensing liquid water or ice. Dispensing assembly 140 includes a dispenser 142, for example, positioned on or mounted to an exterior portion of refrigerator appliance 100 (e.g., on one of doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

The discharging outlet 144 and actuating mechanism 146 may be an external part of dispenser 142 and may be mounted in a dispenser recess 150. Dispenser recess 150 is positioned at a predetermined elevation convenient for a user to access ice or water and enabling the user to access ice without the need to bend-over and without the need to open doors 128. In exemplary embodiments, dispenser recess 150 is positioned at a level that approximates the chest level of a user.

In some embodiments, as shown in FIG. 2, the refrigerator appliance 100 may include a sub-compartment 162 defined on the refrigerator door 128. The sub-compartment 162 is often referred to as an "icebox." Further, as shown, the sub-compartment 162 extends into fresh food chamber 122 when the refrigerator door 128 is in the closed position. Although the sub-compartment 162 is shown in the door 128, additional or alterative embodiments may include the sub-compartment 162 fixed within fresh food chamber 122.

In exemplary embodiments, an ice maker or ice making assembly 160 and an ice storage bin 164 (FIG. 3) are positioned or disposed within the sub-compartment 162. For instance, as shown in FIGS. 3 and 4, the ice making assembly 160 may be positioned, at least in part, above the ice storage bin 164. During use, ice is supplied to dispenser recess 150 (FIG. 1) from the ice making assembly 160 or ice storage bin 164 in the sub-compartment 162 on a back side of refrigerator door 128.

In additional or alternative embodiments, chilled air from a sealed system (not shown) of the refrigerator appliance 100 may be directed into components within the sub-compartment 162 (e.g., the ice making assembly 160 or the storage bin 164 assembly). For instance, the sub-compartment 162 may receive cooling air from a chilled air supply duct 165 and a chilled air return duct 167 (FIG. 2) disposed on a side portion of cabinet 102 of the refrigerator appliance 100. In this manner, the supply duct 165 and the return duct 167 may recirculate chilled air from a suitable sealed cooling system through the ice making assembly.

In optional embodiments, as shown in FIG. 2, an access door 166 may be hinged to the refrigerator door 128. Thus, the access door 166 may permit selective access to the sub-compartment 162. Any manner of suitable latch 168 may be configured with the sub-compartment 162 to maintain the access door 166 in a closed position. As an example, the latch 168 may be actuated by a user in order to open the access door 166 for providing access into the sub-compartment 162. The access door 166 can also assist with insulating the sub-compartment 162 (e.g., by thermally isolating or insulating the sub-compartment 162 from fresh food chamber 122). It is noted that although the access door 166 is illustrated in exemplary embodiments, alternative embodiments may be free of any separate access door. For instance, the ice storage bin 164 may be immediately visible upon opening the door 128.

In some embodiments, as shown in FIG. 4, a stirring rod 172 or agitator may be configured to rotate within the ice storage bin 164. In particular, a motor (not shown) may be mounted to the ice storage bin 164 and may be in mechanical communication with the stirring rod 172 for selectively rotating the stirring rod 172 inside the ice storage bin 164.

Figure 5:
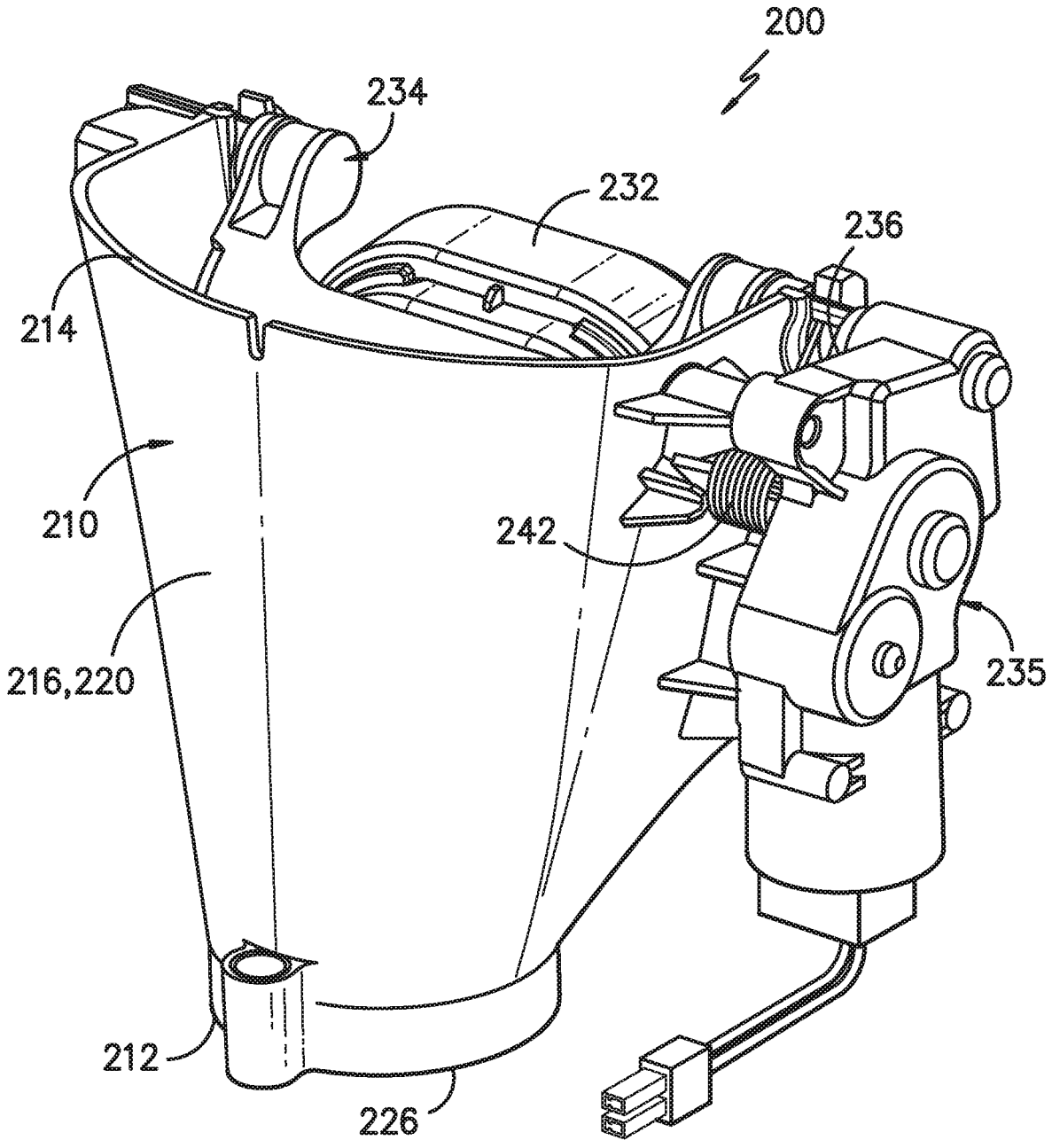
FIG. 5 provides a perspective, front view of an ice dispenser assembly for a refrigerator appliance according to exemplary embodiments of the present disclosure.

Thus, when a user engages actuating mechanism 146 (FIG. 1), the motor rotates the stirring rod 172 to direct ice from the ice making assembly 160 down through a chute or duct 174 and into an ice dispensing assembly 200 (also sometimes referred to as a funnel assembly). As shown in FIGS. 4 and 5, the ice dispensing assembly 200 includes a dispenser housing 210, such as a funnel-shaped housing, that defines at least one side wall 220 that includes the dispenser 142 and an opening 230 in fluid communication with the ice making assembly 160. Moreover, as shown, the ice dispensing assembly 200 includes an ice or duct door 232 at the bottom of the chute 174 and covering the opening 230 so as to allow the ice to pass therethrough when the door is in the open position. More specifically, when a user presses the actuating mechanism 146, a switch is activated to send power to motors that drive the ice door 232 and the stirring rod 172, respectively. As this occurs, ice is moved radially via the rod 172 to an opening in the bottom of the ice bin 164 to allow the ice to fall through the chute 174 and through the open ice door 232. Further details of the ice dispenser assembly 200 are described herein below.

Referring particularly to FIG. 3, operation of the refrigerator appliance 100 may generally be controlled by a processing device or controller 176. The controller 176 may, for example, be operatively coupled to the control panel 148 for user manipulation to select features and operations of the refrigerator appliance 100, such as the ice bin 164 or the ice making assembly 160. The controller 176 can operate various components of the refrigerator appliance 100 to execute selected system cycles and features. In exemplary embodiments, the controller 176 is in operative communication (e.g., electrical or wireless communication) with the ice bin 164. In additional or alternative embodiments, the controller 176 is in operative communication with the ice making assembly 160.

The controller 176 may include a memory and microprocessor, such as a general or special purpose microprocessor operable to execute programming instructions or micro-control code associated with operation of the ice making assembly 160. The memory may represent random access memory such as DRAM, or read only memory such as ROM or FLASH. In one embodiment, the processor executes programming instructions stored in memory. The memory may be a separate component from the processor or may be included onboard within the processor. Alternatively, the controller 176 may be constructed without using a microprocessor (e.g., using a combination of discrete analog or digital logic circuitry; such as switches, amplifiers, integrators, comparators, flip-flops, AND gates, and the like) to perform control functionality instead of relying upon software. One or more portions of the ice bin 164 or the ice making assembly 160 may be in communication with controller 176 via one or more signal lines or shared communication busses.

Figure 6:
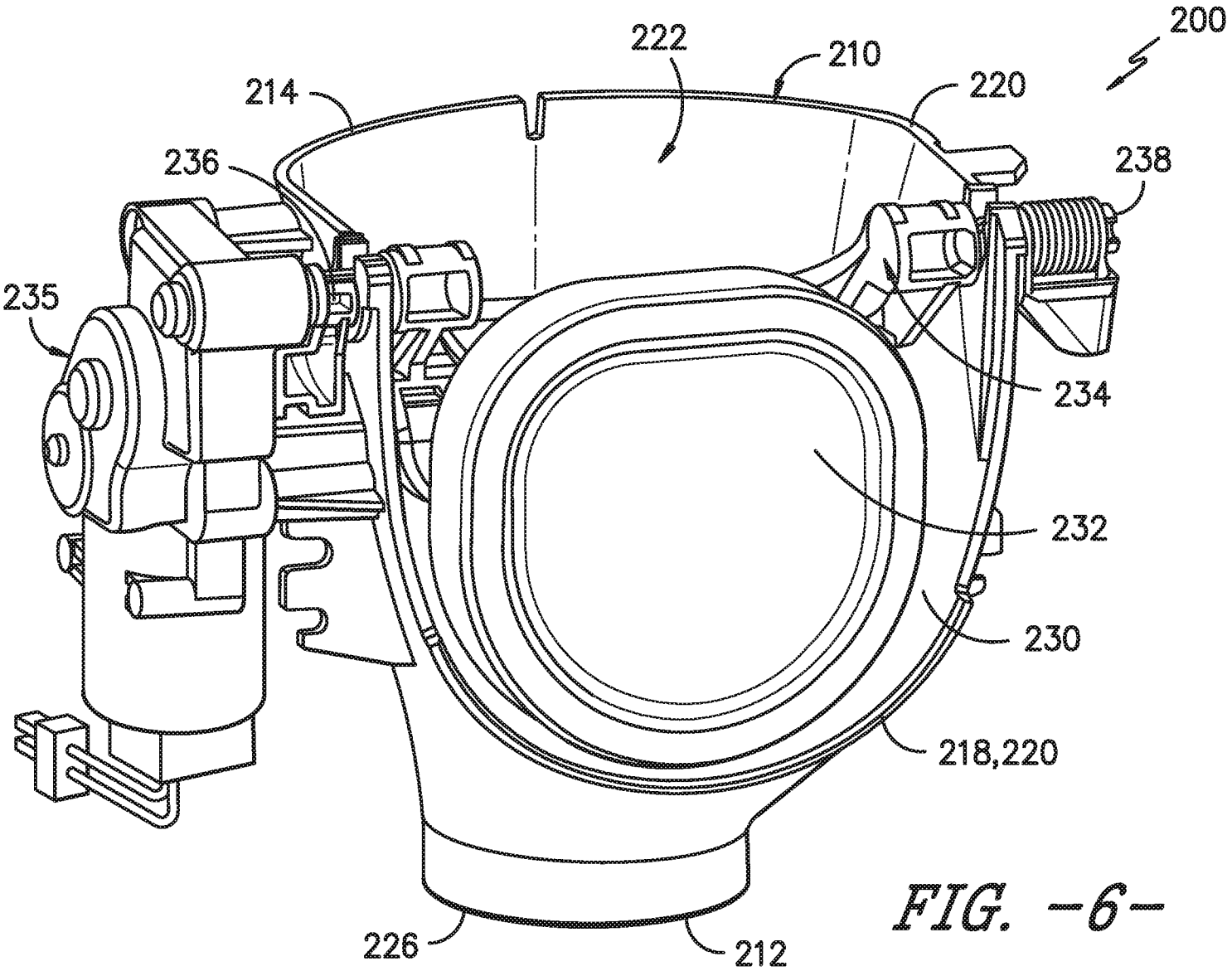
FIG. 6 provides a perspective, rear view of an ice dispenser assembly for a refrigerator appliance according to exemplary embodiments of the present disclosure.
Figure 7:
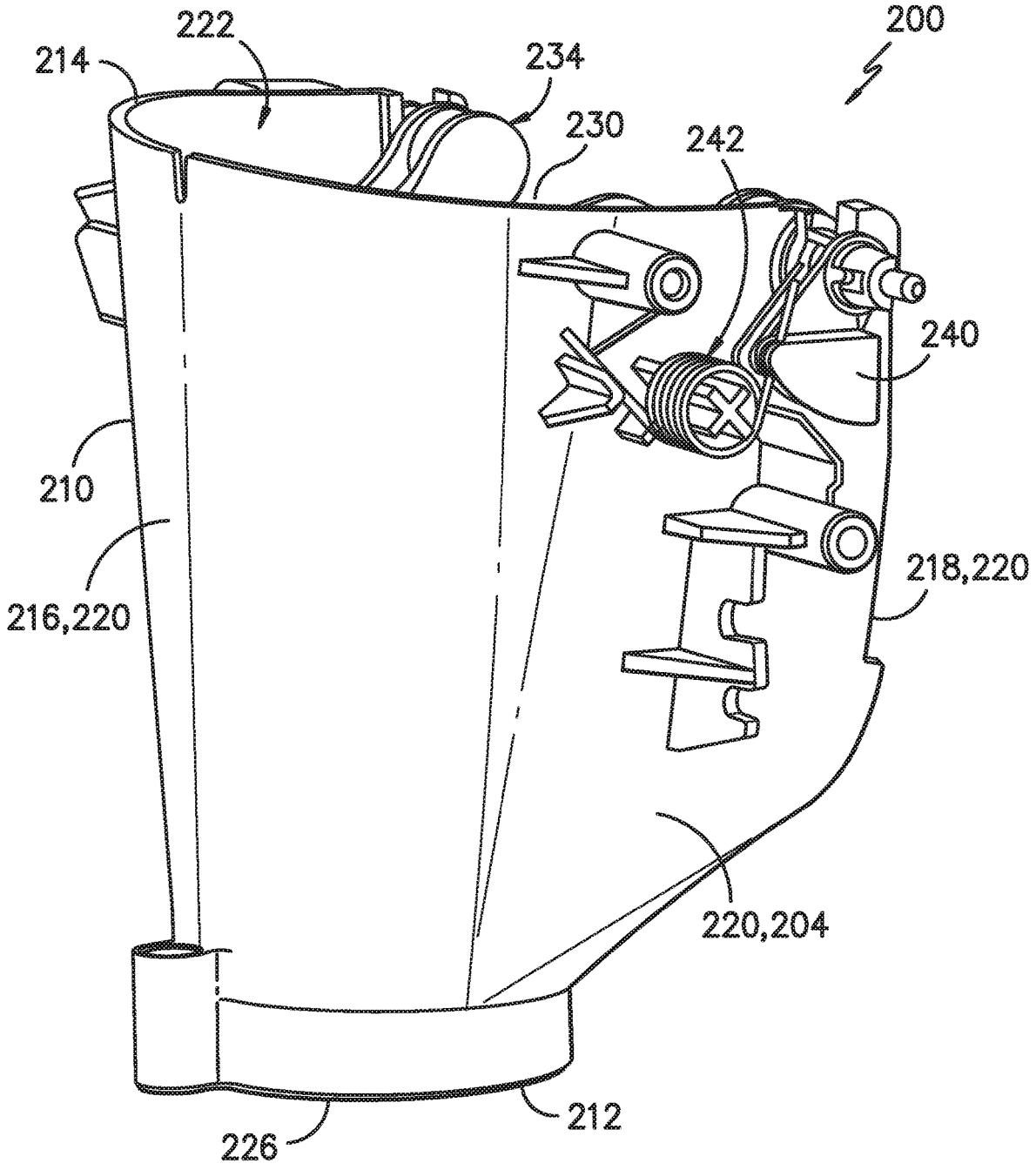
FIG. 7 provides a perspective, first side view of an ice dispenser assembly for a refrigerator appliance according to exemplary embodiments of the present disclosure.

Turning generally to FIGS. 5 through 13, various views are provided of the ice dispenser assembly 200 according to exemplary embodiments of the present disclosure. In particular, as shown in FIGS. 5-8, the dispenser housing 210 of the ice dispenser assembly 200 generally extends along the vertical direction V from a bottom end 212 to a top end 214. The dispenser housing 210 may generally be formed as a solid, nonpermeable structure having one or more sidewalls 220 defining an internal volume 222 (FIGS. 5 and 7).

In certain embodiments, the sidewall(s) 220 may include a front wall 216 and a rear wall 218. When the dispenser housing 210 is positioned or mounted within the dispenser recess 150 (FIG. 3), the front wall 216 may generally be positioned forward from the rear wall 218. Specifically, as shown particularly in FIG. 9, the front wall 216 may be positioned proximal to the door 128 while the rear wall 218 may be positioned proximal to the fresh food compartment 122 (e.g., along the transverse direction T as would be defined when the corresponding door 128 is in the closed position). In addition, as shown, the rear wall 218 may include the opening 230 in fluid communication with the chute 174 that transports ice from the ice making assembly 160 (FIG. 3). Further, at the bottom end 212 of the dispenser housing 210, the dispenser housing 210 may define a dispenser opening 226 through which ice may pass e.g. to a user's cup held at the actuating mechanism 146.

Figure 11:
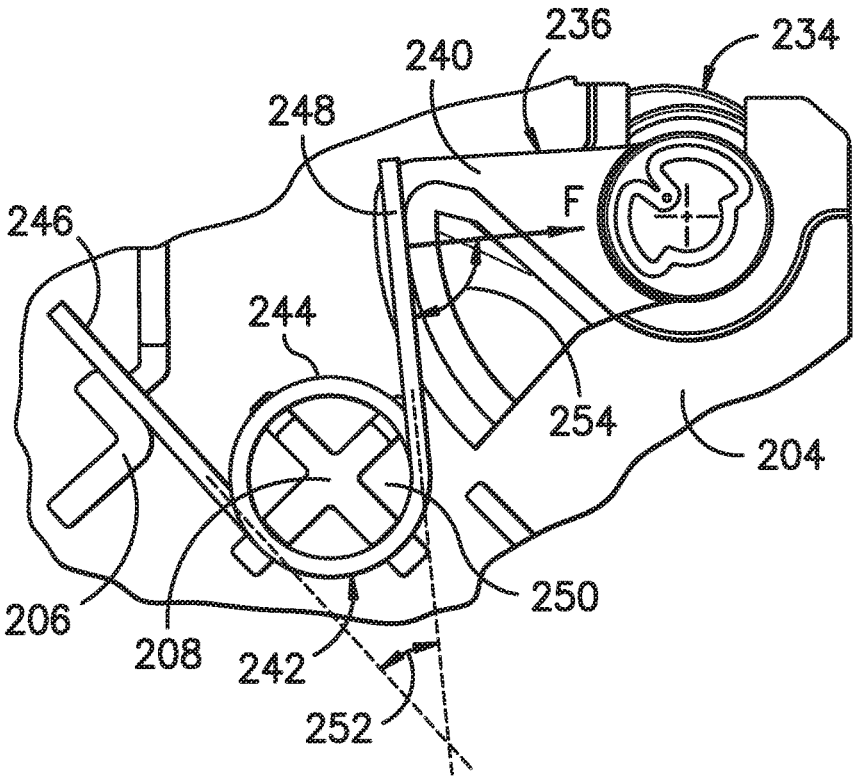
FIG. 11 provides a detailed, side view of an ice dispenser assembly for a refrigerator appliance according to exemplary embodiments of the present disclosure, particularly illustrating a first torsion spring engaging a cam in an open position.
Figure 12:
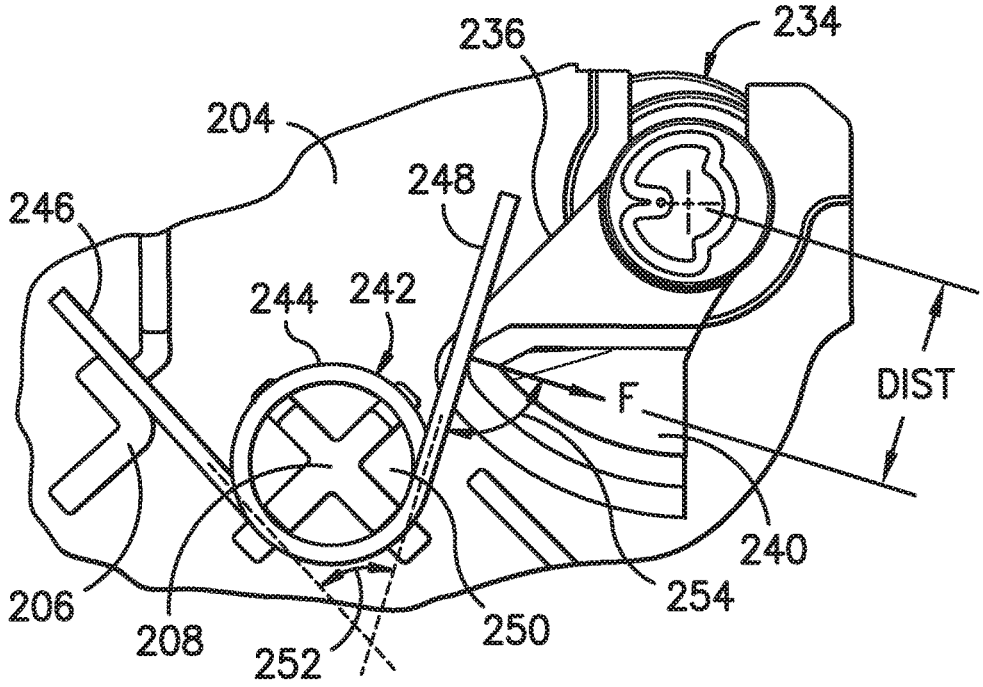
FIG. 12 provides a detailed, side view of an ice dispenser assembly for a refrigerator appliance according to exemplary embodiments of the present disclosure, particularly illustrating a first torsion spring engaging a cam in a closed position.

Additionally or alternatively, each wall may be integrally-formed with the other walls (e.g., such that dispenser housing 210 is provided as a unitary monolithic member). In an embodiment, the side wall(s) 220 of the dispenser housing 210 defines an exterior surface 204. Thus, as shown in FIGS. 7, 11, and 12, the exterior surface 204 may include a plurality of attachment features 206, 208 formed thereon. For example, as shown, the plurality of attachment features may include, at least, a first attachment feature 206 and a second attachment feature 208, which will be described in more detail herein below.

Referring particularly to FIGS. 5-12, the ice door 232 of the ice dispenser assembly 200 may be rotatable between an open position (FIG. 11) permitting ice from the ice maker to pass therethrough and a closed position (FIGS. 9, 10, and 12) restricting cooled air from escaping from the ice maker. Further, as shown in FIGS. 5-13, the ice dispenser assembly 200 includes a rotatable arm 234 coupled to the ice door 232 for rotating the ice door 232 between the open position (FIG. 11) and the closed position (FIG. 12). For example, as shown in FIGS. 5 and 6, the ice dispenser assembly 200 may include a motor 235 for driving the rotatable arm 234 between the open position and the closed position.

Figure 13:
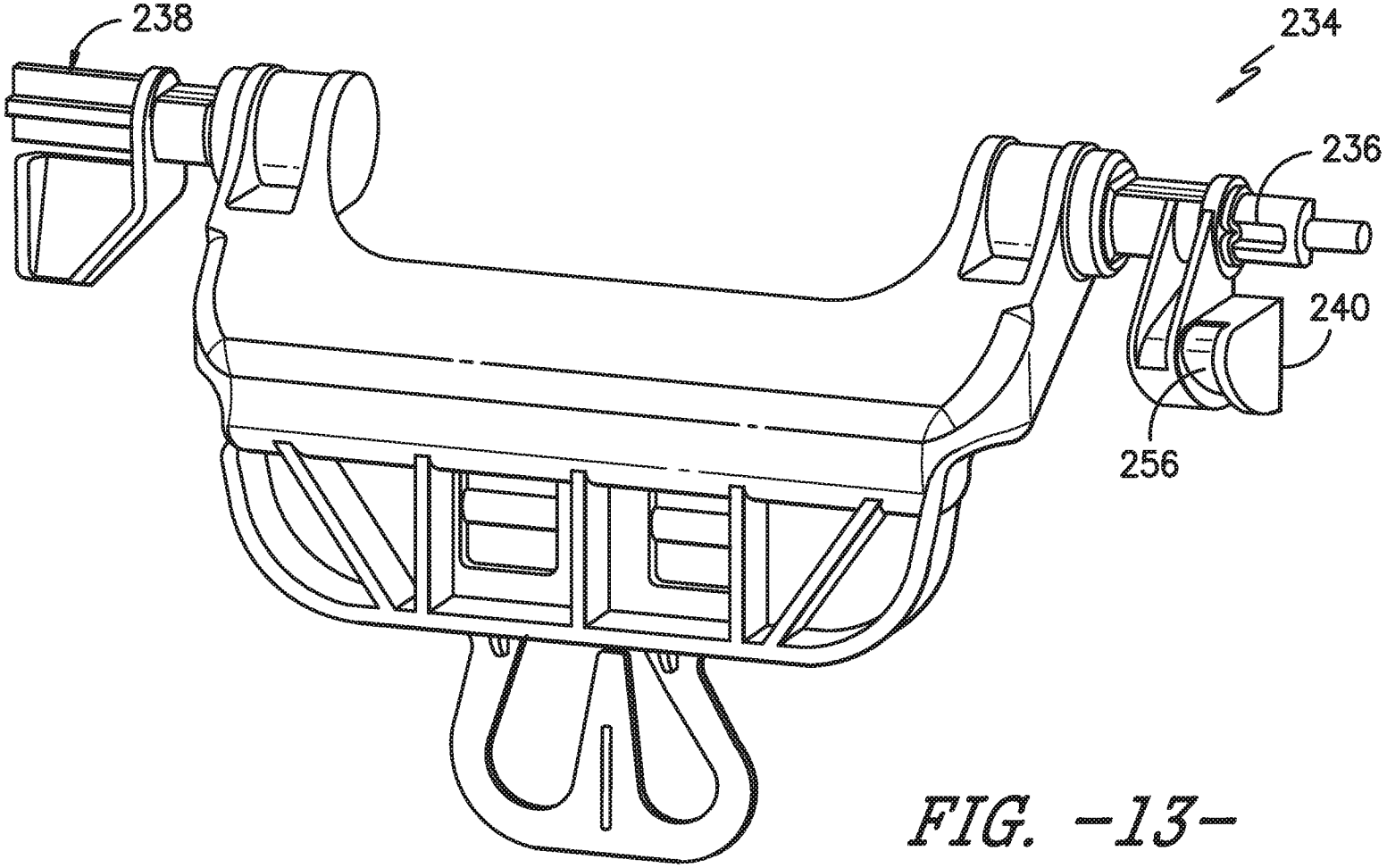
FIG. 13 provides a perspective view of a rotatable arm of an ice dispenser assembly for a refrigerator appliance according to exemplary embodiments of the present disclosure.

Furthermore, as shown specifically in FIG. 13, the rotatable arm 234 may extend across the opening 230 of the dispenser housing 210 between a first end 236 and a second end 238. Accordingly, the rotatable arm 234 may be fixed at the first and second ends 236, 238 such that the ice door 232 rotates about an axis defined by the first and second ends 236, 238. Moreover, as shown in FIGS. 11-13, the first end 236 includes a cam 240 extending therefrom. In addition, as shown in FIGS. 5, 7, 11, and 12, the ice dispenser assembly 200 includes a first torsion spring 242 that engages the cam 240 in the open position (FIG. 11) and the closed position (FIG. 12). More specifically, as shown in FIGS. 11 and 12, a torque of the first torsion spring 242 against the cam 240 is greater in the closed position than the open position, thereby providing improved sealing means of the ice door 232 in the closed position.

Further, the motor 235 may be secured to the first end 236 of the rotatable arm 234. In such embodiments, the motor 235 may not provide any closing torque, but must overcome the spring torque while opening the ice door 232. Thus, freedom to manually open the ice door 232 against the stationary motor 235 allows a user to free an ice jam without damaging the motor gearing.

For example, as shown in FIGS. 11 and 12, the first torsion spring 242 includes a spring body 244 with opposing side ends 246, 248 extending therefrom. More specifically, as shown, the opposing side ends includes a first side end 246 and a second side end 248. Thus, as shown, the first side end 246 engages the first attachment feature 206, the spring body 244 engages the second attachment feature 208, and the second side end 248 engages the cam 240 so as to apply the torque to the cam 240. More specifically, as shown, the first side end 246 rests upon the first attachment feature 206, whereas the spring body 244 of the first torsion spring 242 forms an open passageway 250 that fits around the second attachment feature 208.

Accordingly, as shown, when the ice door 232 is in the open position (FIG. 11), an angle 252 of the second side end 248 with respect to the first side end 246 is less than the angle 252 of the second side end 248 with respect to the first side end 246 in the closed position (FIG. 12). Thus, when the ice door 232 is in the open position (FIG. 11), a moment placed on the cam 240 due to the torque applied by the second side end 248 is zero or negligible due to an angle 254 of applied force of the second side end 248 against the cam 240 passing through the pivot of the rotatable arm 234. Further, when the ice door 232 is in the closed position (FIG. 12), the moment placed on the cam 240 due to the torque applied by the second side end 248 is at a maximum value due to the angle 254 of applied force of the second side end 248 against the cam 240 passing at a distance spaced apart from the pivot of the rotatable arm 234.

In addition, in certain embodiments, as shown in FIG. 13, the cam 240 on the rotatable arm 234 may include at least one recess 256 or notch configured to receive the second side end 248 so as to maintain engagement with the second side end 248, i.e. to prevent the second side end 248 from sliding off of the cam 240.

Figure 8:
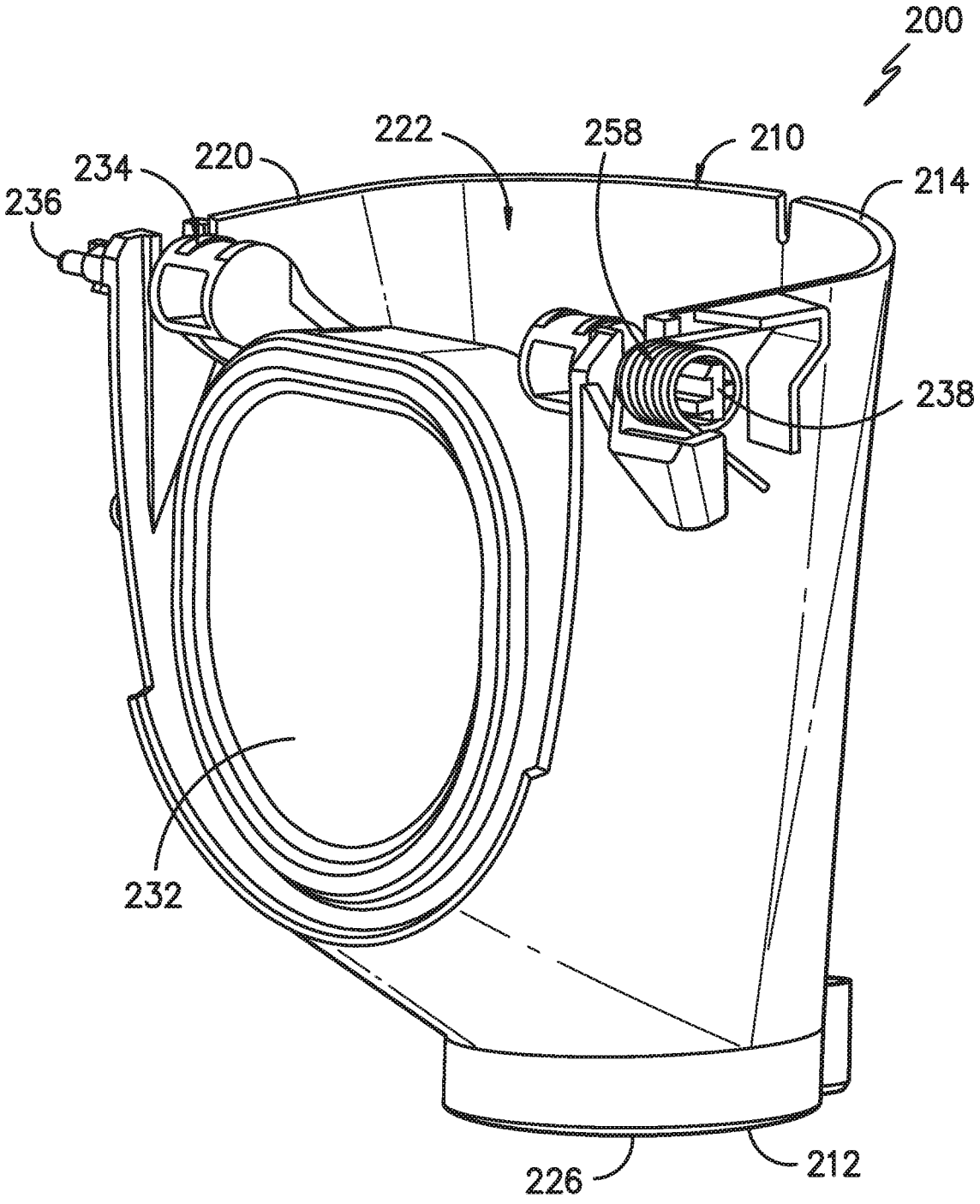
FIG. 8 provides a perspective, second side view of an ice dispenser assembly for a refrigerator appliance according to exemplary embodiments of the present disclosure.
Figure 9:
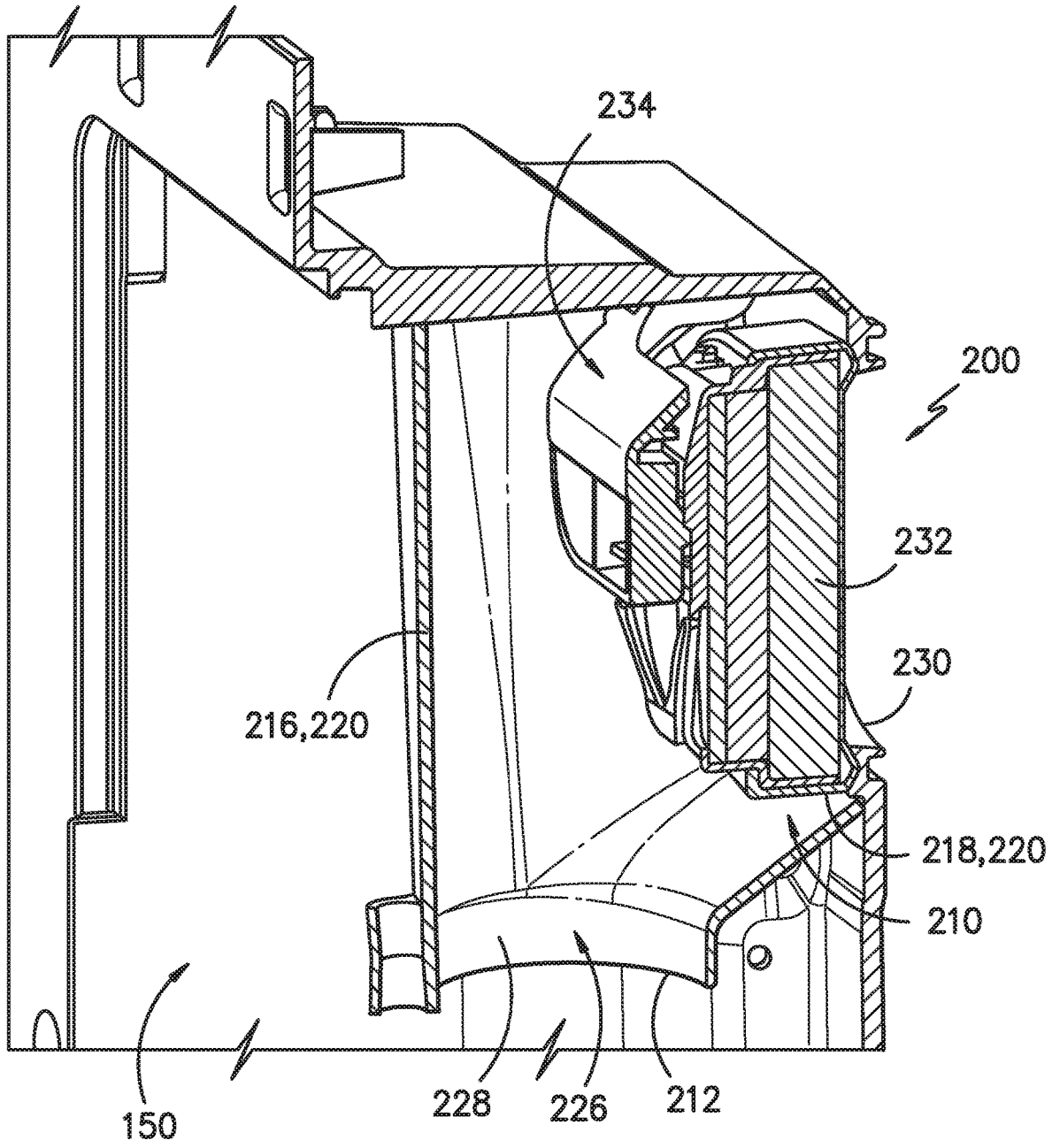
FIG. 9 provides a partial, cross-sectional view of the ice dispenser assembly of the exemplary refrigerator appliance of FIG. 2.
Figure 10:
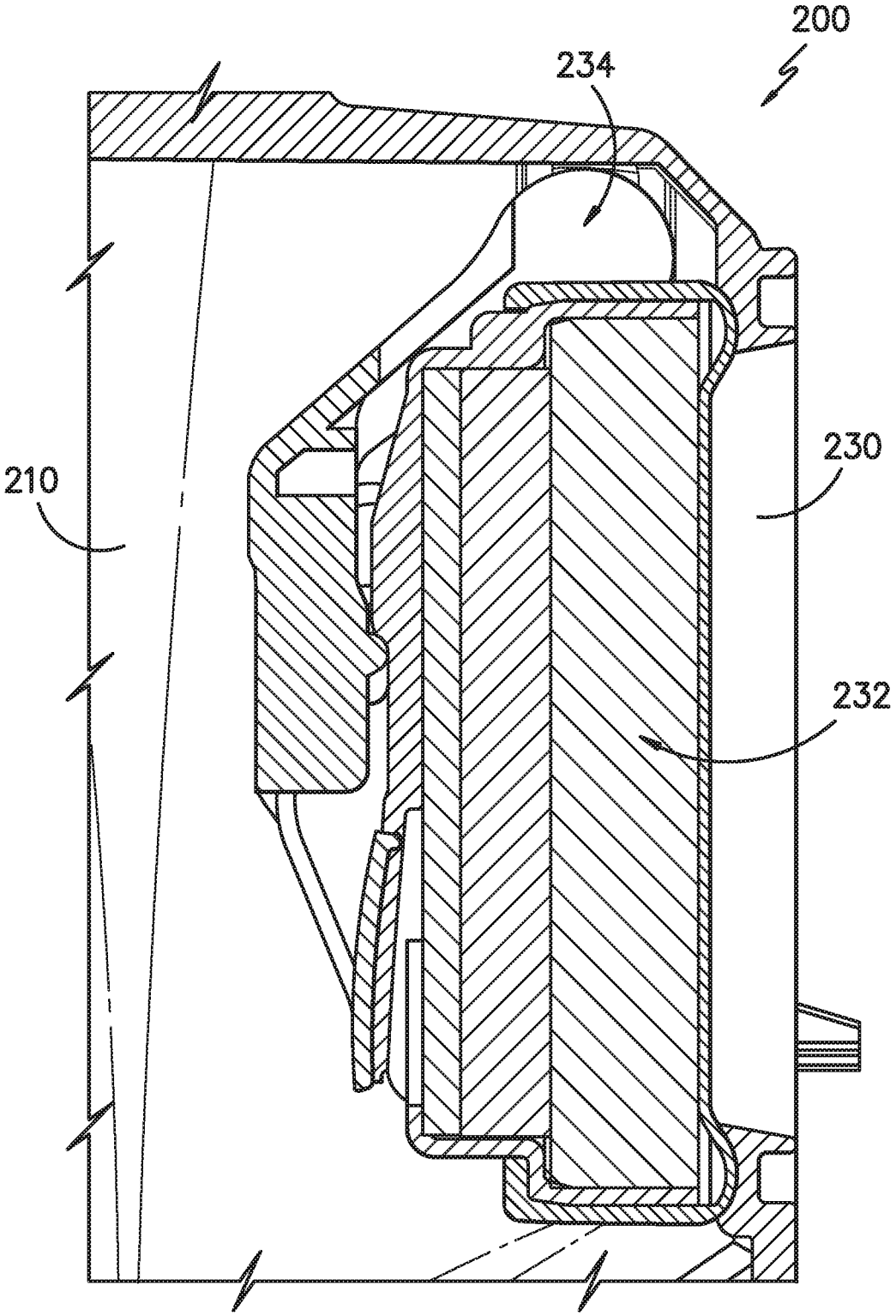
FIG. 10 provides a cross-sectional view of the ice door of the ice dispenser assembly of the exemplary refrigerator appliance of FIG. 2, particularly illustrating the ice door in a closed position.

Referring particularly to FIG. 8, in another embodiment, the second end 238 of the rotatable arm 234 may include an additional, second torsion spring 258 arranged thereon. In such embodiments, the ice dispenser assembly 200 may include two torsion springs, one on each side of the dispenser housing 210. Accordingly, in such embodiments, a torque of the second torsion spring 258 against the rotatable arm 234 may be greater in the open position than the closed position (as opposed to the other way around for the first torsion spring 242). More specifically, in certain embodiments, torque may be applied by the second torsion spring 258 (at its greatest amount) to initiate closing of the ice door 232. Further, when the ice door 232 is in the closed position, the preloaded second torsion spring 258 applies additional torque to keep the door sealed shut (in addition to the torque applied by the first torsion spring 242). Accordingly, since the first torsion spring 242 being applied against the cam provides no torque in its fully opened position, the second torsion spring 258 initiates the torque for the first torsion spring 242 in the closing direction. In the closed position, both springs 242, 258 provide combined torque to clamp and seal the ice door 232 shut.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice dispenser assembly for an ice maker, the ice dispenser assembly comprising:

a dispenser housing defining at least one side wall comprising a dispenser and an opening in fluid communication with the ice maker;

an ice door covering the opening, the ice door rotatable between an open position permitting ice from the ice maker to be received through the dispenser and a closed position restricting cooled air from escaping from the ice maker;

a rotatable arm coupled to the ice door for rotating the ice door between the open position and the closed position, the rotatable arm extending across the opening between a first end and a second end, the first end comprising a cam; and a first torsion spring engaging the cam in the open position and the closed position, wherein a torque of the first torsion spring against the cam is greater in the closed position than the open position, wherein, in the open position, a moment placed on the cam due to the torque applied by the first torsion spring is negligible due to an angle of applied force against the cam passing through a pivot of the rotatable arm, and wherein, in the closed position, the moment placed on the cam due to the torque applied by the first torsion spring is at a maximum value due to the angle of applied force against the cam passing at a distance spaced apart from the pivot of the rotatable arm.

2. The ice dispenser assembly of claim 1, wherein the at least one side wall of the dispenser housing defines an exterior surface, the exterior surface comprising a plurality of attachment features, the plurality of attachment features comprising, at least, a first attachment feature and a second attachment feature.

3. The ice dispenser assembly of claim 2, wherein the first torsion spring comprises a spring body with opposing side ends extending therefrom, the opposing side ends comprising a first side end and a second side end, the first side end engaging the first attachment feature, the spring body engaging the second attachment feature, the second side end engaging the cam so as to apply the torque to the cam.

4. The ice dispenser assembly of claim 3, wherein, in the open position, an angle of the second side end with respect to the first side end is less than the angle of the second side end with respect to the first side end in the closed position.

5. The ice dispenser assembly of claim 3, wherein the cam further comprises at least one recess configured to receive the second side end so as to maintain engagement with the second side end.

6. The ice dispenser assembly of claim 3, wherein the spring body forms an open passageway that fits around the second attachment feature.

7. The ice dispenser assembly of claim 1, wherein the second end of the rotatable arm comprises a second torsion spring arranged thereon.

8. The ice dispenser assembly of claim 7, wherein a torque of the second torsion spring against the rotatable arm is greater in the open position than the closed position.

9. The ice dispenser assembly of claim 1, further comprising a motor for driving the rotatable arm between the open position and the closed position.

10. The ice dispenser assembly of claim 9, wherein the motor is secured to the first end of the rotatable arm.

11. A refrigerator appliance, comprising:

a cabinet defining a chilled chamber;

a door permitting access to the chilled chamber; and an ice maker received within the chilled chamber; and an ice dispenser assembly for dispensing ice from the ice maker, the ice dispenser assembly comprising:

a dispenser housing defining at least one side wall comprising a dispenser and an opening in fluid communication with the ice maker;

an ice door covering the opening, the ice door rotatable between an open position permitting ice from the ice maker to be received through the dispenser and a closed position restricting cooled air from escaping from the ice maker;

a rotatable arm coupled to the ice door for rotating the ice door between the open position and the closed position, the rotatable arm extending across the opening between a first end and a second end, the first end comprising a cam; and a first torsion spring engaging the cam in the open position and the closed position, wherein a torque of the first torsion spring against the cam is greater in the closed position than the open position, wherein, in the open position, a moment placed on the cam due to the torque applied by the first torsion spring is negligible due to an angle of applied force against the cam passing through a pivot of the rotatable arm, and wherein, in the closed position, the moment placed on the cam due to the torque applied by the first torsion spring is at a maximum value due to the angle of applied force against the cam passing at a distance spaced apart from the pivot of the rotatable arm.

12. The refrigerator appliance of claim 11, wherein the at least one side wall of the dispenser housing defines an exterior surface, the exterior surface comprising a plurality of attachment features, the plurality of attachment features comprising, at least, a first attachment feature and a second attachment feature.

13. The refrigerator appliance of claim 12, wherein the first torsion spring comprises a spring body with opposing side ends extending therefrom, the opposing side ends comprising a first side end and a second side end, the first side end engaging the first attachment feature, the spring body engaging the second attachment feature, the second side end engaging the cam so as to apply the torque to the cam.

14. The refrigerator appliance of claim 13, wherein, in the open position, an angle of the second side end with respect to the first side end is less than the angle of the second side end with respect to the first side end in the closed position.

15. The refrigerator appliance of claim 11, wherein the second end of the rotatable arm comprises a second torsion spring arranged thereon, wherein a torque of the second torsion spring against the rotatable arm is greater in the open position than the closed position.

16. The refrigerator appliance of claim 11, further comprising a motor for driving the rotatable arm between the open position and the closed position, wherein the motor is secured to the first end of the rotatable arm.

* * * * *